US007739887B2

(12) United States Patent
Hung

(10) Patent No.: US 7,739,887 B2
(45) Date of Patent: Jun. 22, 2010

(54) KNITTED BAND FOR ZIPPER

(76) Inventor: Da-An Hung, No. 201, Zhenxi Rd., Hemei Town, Changhua County (TW) 508

( * ) Notice: Subject to any disclaimer, the term of this patent is extended or adjusted under 35 U.S.C. 154(b) by 417 days.

(21) Appl. No.: 11/759,968

(22) Filed: Jun. 8, 2007

(65) Prior Publication Data

US 2008/0301914 A1 Dec. 11, 2008

(51) Int. Cl.
*D04B 22/20* (2006.01)

(52) U.S. Cl. ..... 66/195; 66/193

(58) Field of Classification Search ..... 66/193, 66/195, 190, 192; 24/391, 397, 393, 398
See application file for complete search history.

(56) References Cited

U.S. PATENT DOCUMENTS 5,502,986 A * 4/1996 Matsuda et al. ..... 66/193
5,540,064 A * 7/1996 Matsuda et al. ..... 66/193
5,615,563 A * 4/1997 Matsuda et al. ..... 66/193
5,685,177 A * 11/1997 Matsuda et al. ..... 66/193
5,794,460 A * 8/1998 Matsuda et al. ..... 66/193
6,006,552 A * 12/1999 Matsuda et al. ..... 66/193
6,148,643 A * 11/2000 Matsuda et al. ..... 66/193
6,651,296 B2 * 11/2003 Matsuda ..... 66/190
6,971,253 B2 * 12/2005 Matsuda et al. ..... 66/193
7,240,521 B2 * 7/2007 Matsuda ..... 66/193

* cited by examiner

*Primary Examiner*—Danny Worrell
(74) *Attorney, Agent, or Firm*—WPAT, PC; Justin King

(57) ABSTRACT

A woven band for a zipper is provided. The woven band is made by a double needle bar raschel knitting machine and has a predetermined length in a warp direction. The woven band includes a convex portion formed on one side thereof for joining to a zipper and a band portion connected to the convex portion. As the convex portion has large thickness and high strength, the joint strength of the convex portion and the zipper is increased.

4 Claims, 5 Drawing Sheets

KNITTED BAND FOR ZIPPER

BACKGROUND OF THE INVENTION

1. Field of the Invention

The present invention relates to a knitted band for a zipper, and in particular relates to a knitted band having a convex portion on one side to join the zipper to enhance strength.

2. Description of the Related Art

Accordingly, a zipper comprises a pair of bands, a pair of teeth strips fixed to the band and a head engaging or releasing the teeth strips. The bands are stitched to cloth, hand bags or luggage box.

When a zipper is used, traverse force is exerted on the zipper, especially for the zipper on a hand bag or a luggage box. The teeth strips are made of material of high strength, such as Nylon or copper. The junction of the teeth strips and the knitted bands is the most weak point of the zipper. It is easily damaged by large traverse force.

To improve the strength of the junction of the teeth strips and the bands, reinforce threads having a diameter large than the threads of the band are used. In such a structure, although the strength is increased, the reinforce thread cannot be completely knitted with other threads of the bands, which causes uneven surface of the band resulting in unsmooth running of the head.

BRIEF SUMMARY OF INVENTION

The object of the invention is to provide a knitted band having a convex portion on one side thereof. The convex portion is joined to a teeth stripe of a zipper to enhance the strength.

Another object of the invention is to provide a knitted band with an even surface and beautiful shape.

Another object of the invention is to provide a knitted band capable of traversely stretching and smooth the usage of the zipper.

Another object of the invention is to provide a knitted band with a high strength in the junction of the convex portion and a band portion of the knitted band, which causes a high joint strength of the zipper and the knitted band.

The knitted band of the invention is made by a double needle bar raschel knitting machine and has a predetermined length in a warp direction. The knitted band comprises a convex portion formed on one side thereof for joining to a zipper and a band portion connected to the convex portion.

To obtain the convex portion of larger thickness, the convex portion can be formed by threads of larger number than the band portion or formed by threads of larger number and diameter than the band portion, whereby the convex portion has large thickness and high strength, the joint strength of the convex portion and the zipper is also increased.

When the convex portion is formed by threads of larger number than the treads used in the band portion, the convex portion, no twist or crepe is occurred which causes a smooth surface of the knitted band.

As the band portion has structures cross more than two needle pitches, the band portion is capable of traverse stretching. When the zipper is open or closed, the band portion 62 can be stretched as a damper to smooth the zipper open or close.

As the structure constituting the band portion is knitted with the structures constituting the convex portion and the threads used is more than other part, the joint strength of the band portion and the convex portion and the joint strength of the zipper and the knitted band are increased.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

Figure 1:
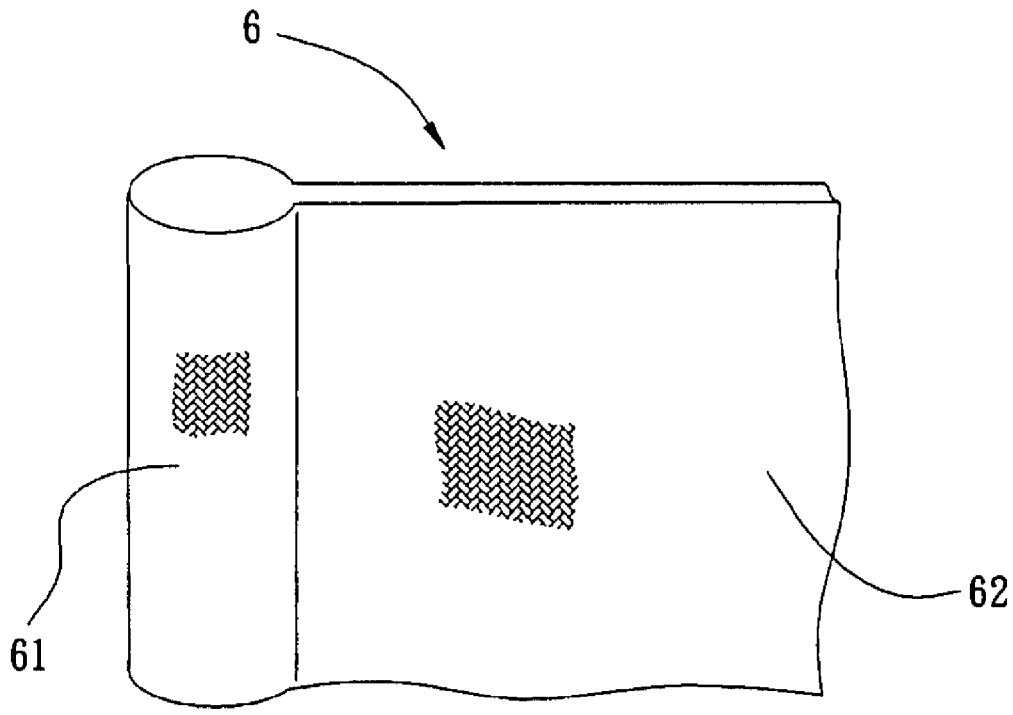
FIG. 1 is a schematic view of a knitted band of the invention.

Referring to FIG. 1, the knitted band is made by a double needle bar raschel knitting machine. The knitted band has a predetermined length along a warp direction and comprises a convex portion 61 on one side thereof for joining to a teeth strip 71 of a zipper 7 and a band portion 62 connected to the convex portion 61.

Figure 2:
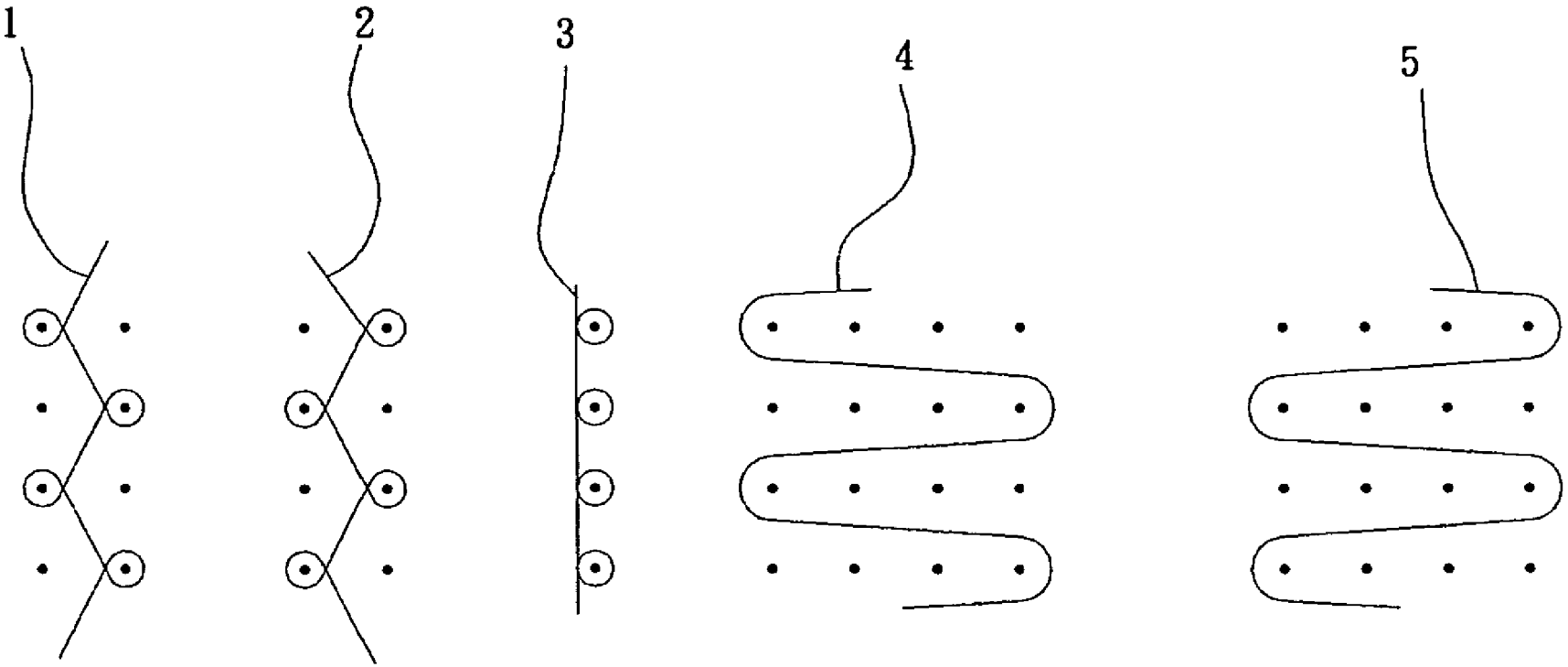
FIG. 2 depicts each structure of the knitted band.
Figure 3:
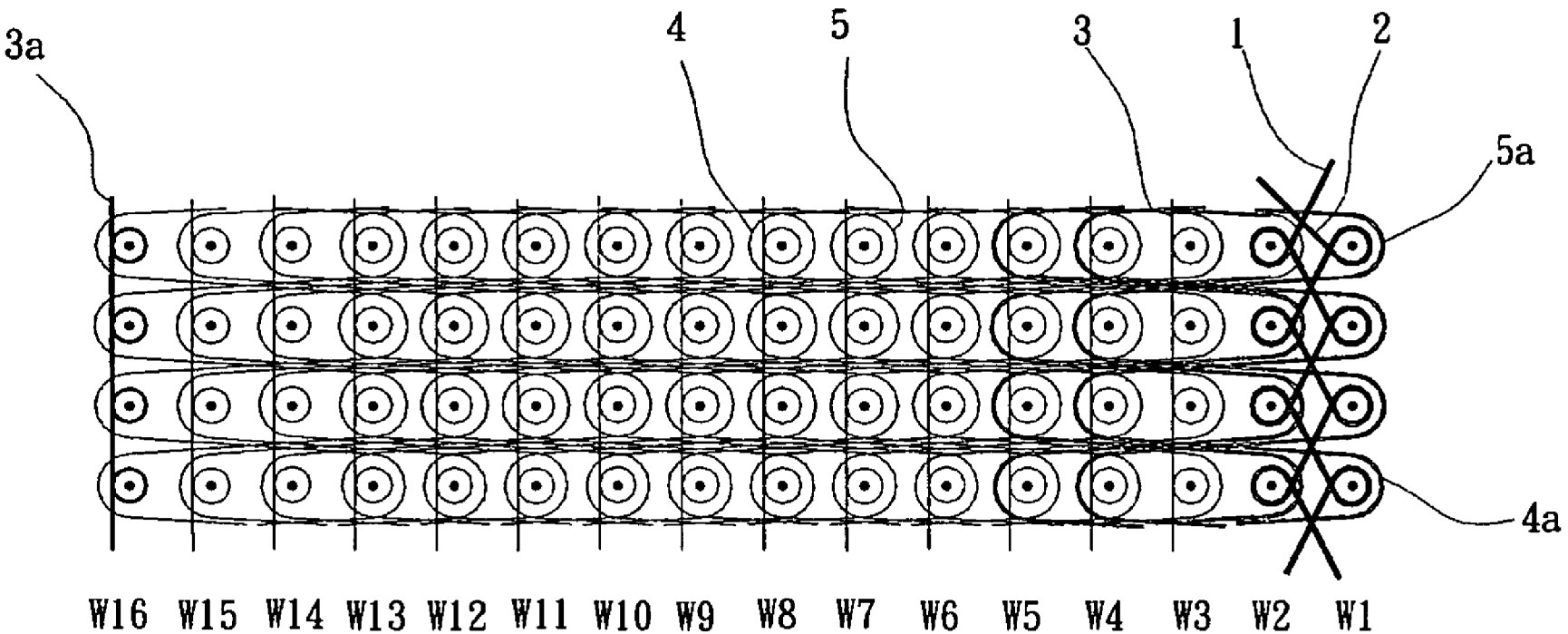
FIG. 3 depicts the structures of FIG. 2 assembled to be the knitted band.

Referring to FIGS. 2 and 3, the knitted band 6 comprises a first structure 1 which is 10/12 type, a second structure 2 which is 12/10 type interlacing the first structure, a third structure formed lap-by-lap as a chain like shape along the warp direction without weaving with the first and second structures 1 and 2, a fourth structure 4 along a woof direction for more than two needle pitches and a fifth structure 5 along a woof direction for more than two needle pitches interlacing the fourth structure 4. Although the third structure is 10/10 and left-chain type in this embodiment, it can be, however, a right-chain type or middle chain type. The fourth structure 4 and the fifth structure 5 are knitted with the first structure 1 and the second structure 2 respectively. In this embodiment, the fourth structure 4 is 00/44 type and the fifth structure 5 is 44/00 type.

In this embodiment (FIG. 3), 16 wales are described as an example. The first structure 1 (10/12 type) and the second structure 2 (12/10 type) are interlaced between the wales W1 and W2, and formed by directing 8 to 10 threads into the same guide hole of the double needle bar raschel knitting machine. Because the first and second structures 1 and 2 are formed by several threads interlaced between two wales, the thickness is considerable large, which forms the convex portion 61 on one side of the knitted band 6.

The third structure 3, the 10/10 left-chain type, is circled by a first needle first and then circled by a second needle and knitted to the wales W3 to W16 adjacent to the convex portion 61. The third structure 3 is knitted by directing one or two threads into the same guide hole of the double needle bar raschel knitting machine. One thread is added to be directed into the same guide hole at the wale W16 away from the convex portion 61 to form a reinforced third structure 3*a* which increases the longitudinal strength and makes the knitted band 6 more even.

Figure 4:
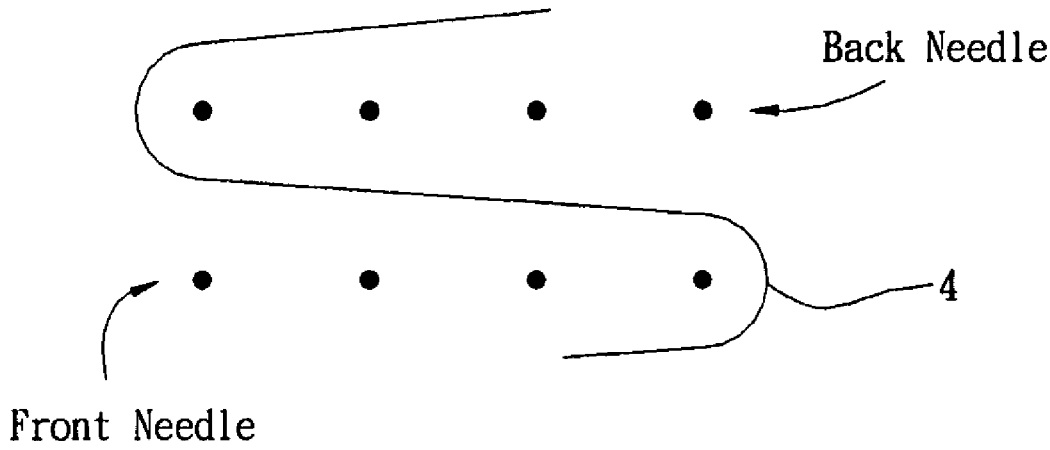
FIG. 4 depicts the fourth structure knitted by a double needle bar raschel knitting machine.

The fourth structure 4, the 00/44 type, and the fifth structure 5, the 44/00 type, are along the woof direction for four needle pitches (shown in FIG. 4) and located between the chain-shape structures. The band portion is formed by weaving thirteen threads into wales W1 to W16. The threads used in the part of the fourth structure 4 and the fifth structure 5 knitted with the first and second structures 1 and 2 are more than the part of the fourth structure 4 and the fifth structure 5 not knitted with the first and second structures 1 and 2, whereby the fourth structure 4 and the fifth structure 5 have reinforce portions 4*a* and 5*a* (shown in FIG. 3) adjacent to respectively convex portion 61. In practice, the fourth structure 4 and the fifth structure 5 is formed by directing one or two threads into the same guide hole of the double needle bar raschel knitting machine and moving between two needles in the woof direction matching the third structure 3. In the reinforce portion 5*a* and 5*a*, one or two threads are added.

Figure 5:
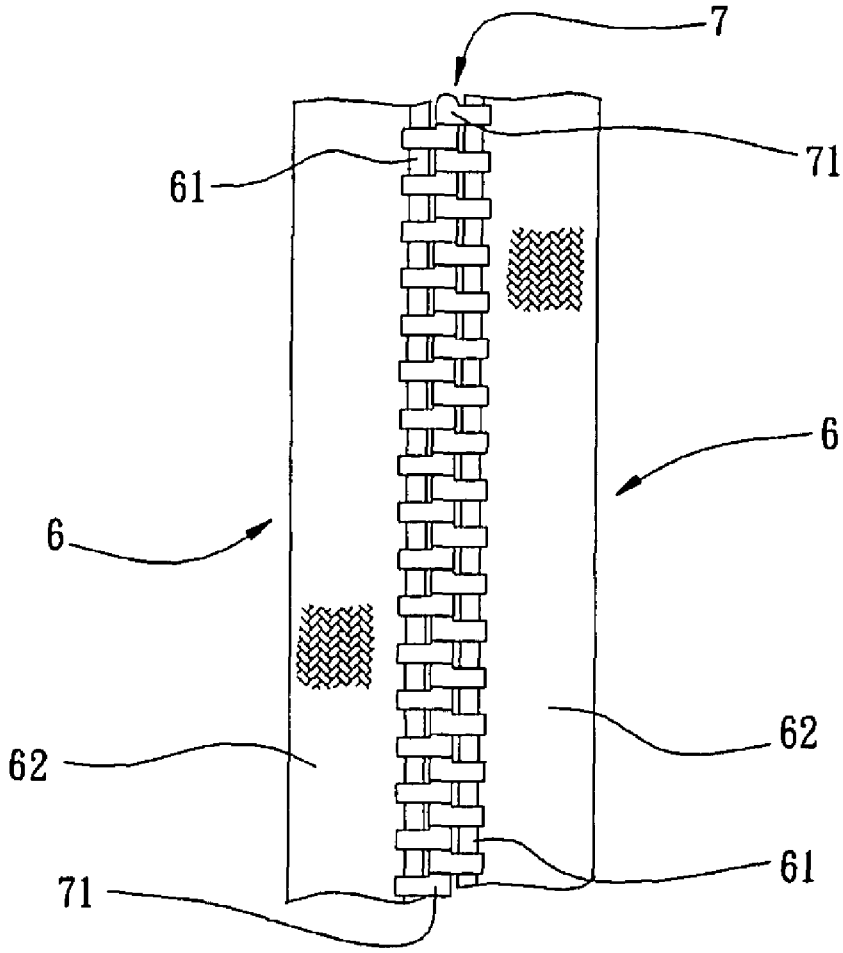
FIG. 5 depicts the knitted band joined to a teeth strip of a zipper.
Figure 6:
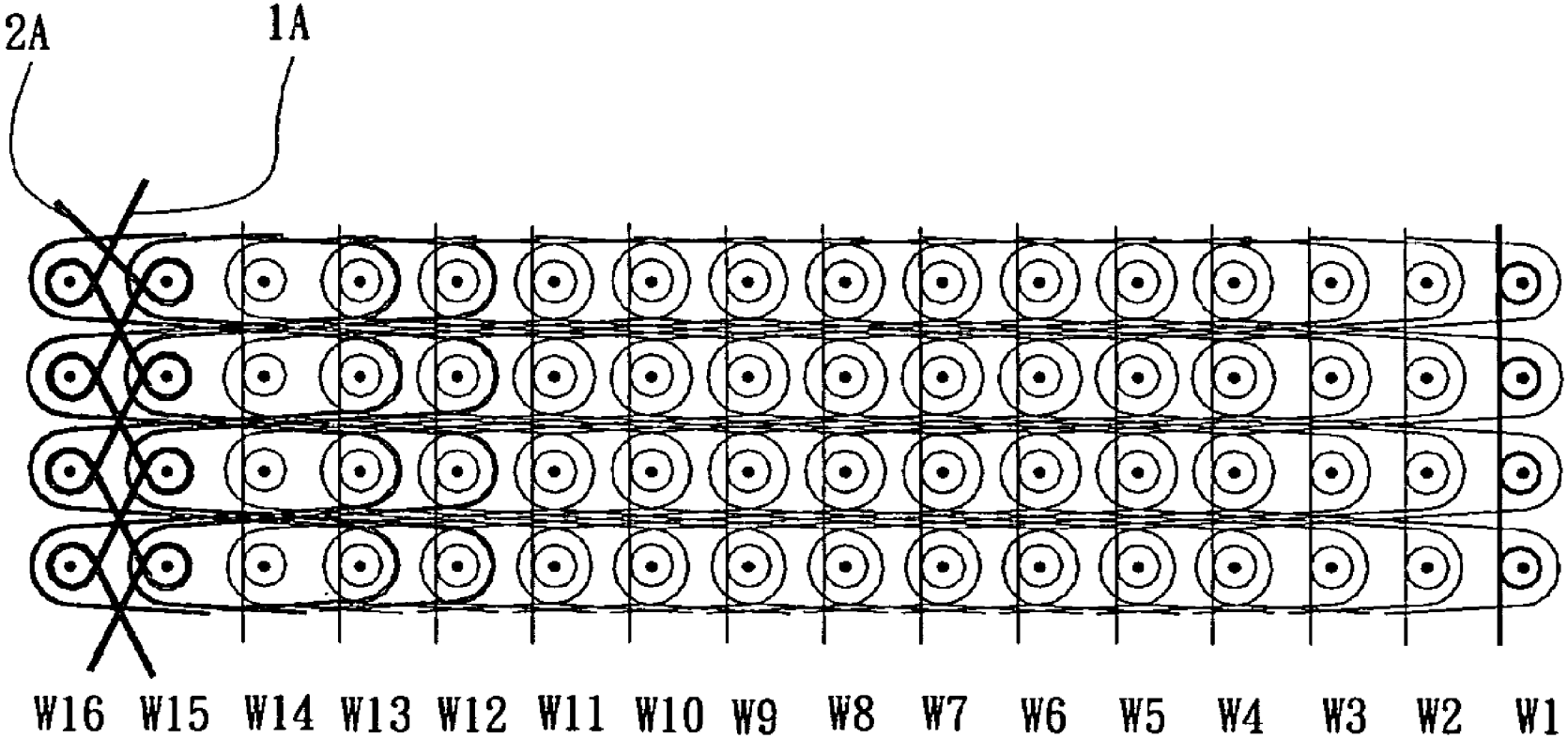
FIG. 6 is a symmetrical view of FIG. 3.

The knitted band for a zipper is a symmetrical structure as shown in FIG. 5 which depicts a left knitted band. FIG. 6 depicts the right knitted band, the first structure 1A and the second structure 2A is interlaced between the wales W15 and W16. The third structure 3 has one more thread added to the wale W1. The two symmetrical knitted bands manufactured in the same machine and in one procedure are connected to teeth strips of a zipper.

Figure 7:
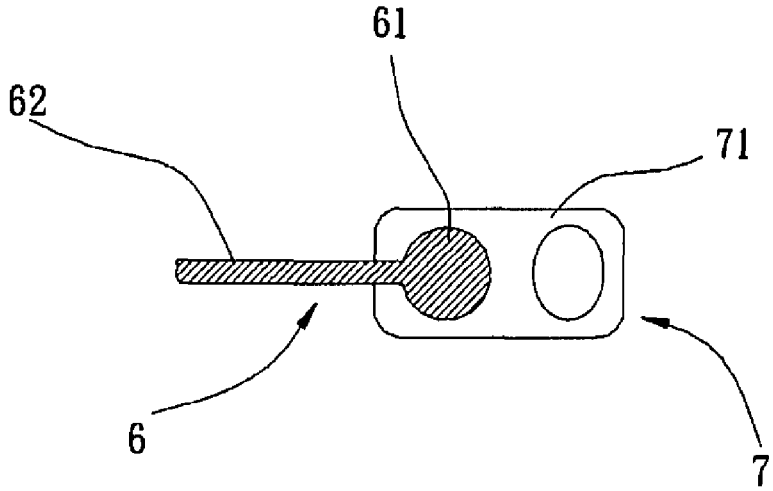
FIG. 7 is a cross section of assembled knitted band and the teeth strip.

As the first structure 1 and the second structure 2 are formed by interlacing several threads, the knitted band has large thickness and high strength as shown in FIG. 7. When the convex portion 61 is joined to the teeth stripe 71 of a zipper 7, the strength is increased and the teeth stripes 71 of the zipper 7 are tightly secured to each other.

Furthermore, as the diameter of the treads used in the convex portion 61 is the same as the treads used in the band portion 62, no twist or crepe is occurred. The treads of the third structure 10/10 is circled by the two needles, a quite smooth surface of the knitted band is obtained.

The knitted band has the same structure on the front side and the back side. One thread is added to the left chain of the third structure 10/10 to form a reinforce structure 3*a*, whereby the longitudinal strength of the knitted band 6 is increased and the surface of the knitted band 6 is smooth.

As the band portion 62 has structures, the fourth structure 4 and the fifth structure 5, cross more than two needle pitches, the band portion 62 is capable of traverse stretching. When the zipper is open or closed, the band portion 62 can be stretched as a damper to smooth the zipper open or close.

In addition, as the threads used in the part of the fourth structure 4 and the fifth structure 5 knitted with the first structure 1 and the second structure 2 are more than other part of the fourth structure 4 and the fifth structure 5, the joint strength of the band portion 62 and the convex portion 61 and the joint strength of the zipper and the knitted band are increased.

The knitted band of the invention has high longitudinal and traverse strengths and smooth surface, and further has a high joint strength with the zipper.

In addition to the described embodiment, the convex portion can be formed by threads having diameter larger than the threads forming the band portion, whereby the convex portion has larger thickness than the band portion. The convex portion can also be formed by threads having diameter and number larger than the threads forming the band portion, whereby the convex portion has larger thickness than the band portion.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A knitted band for a zipper, which is made by a double needle bar raschel knitting machine and has a predetermined length in a warp direction, comprising a first warp structure along the warp direction;

a second warp structure along the warp direction and interlacing the first structure and located on one side of the knitted band along with the first structure;

a third structure along the warp direction as a chain-like shape without weaving with the first and second structures;

a fourth structure along a woof direction for more than two needle pitches;

a fifth structure along the woof direction for more than two needle pitches and interlacing the fourth structure, wherein a part of the fourth structure and the fifth structure is knitted with the first and second structures, and the threads used in the first and second structures are more than the threads used in the third, fourth and fifth structures, whereby the first and second structures form a convex portion joined to the zipper and the third, fourth and fifth structures form a band portion having a thickness less than the convex portion.

2. The knitted band as claimed in claim 1, wherein the diameter of the threads used in the first and second structure is larger than the diameter of the thread used in the third, fourth, and fifth structures.

3. The knitted band as claimed in claim 1, wherein the fourth and fifth structures have more threads knitted with the first and second structure than the threads used in other parts of the fourth and fifth structures.

4. The knitted band as claimed in claim 1, wherein the third structure has less threads with the first and second structure than other parts of the third structure.

* * * * *